United States Patent [19]

Honda

[11] Patent Number: 4,733,547

[45] Date of Patent: Mar. 29, 1988

[54] WASHING MACHINE

[75] Inventor: Kunioki Honda, Shiga, Japan

[73] Assignee: Sanyo Electric Co., Ltd, Japan

[21] Appl. No.: 6,724

[22] Filed: Jan. 23, 1987

Related U.S. Application Data

[62] Division of Ser. No. 733,977, May 14, 1985, Pat. No. 4,662,193.

[30] Foreign Application Priority Data

May 18, 1984 [JP] Japan ..... 59-100824
May 18, 1984 [JP] Japan ..... 59-100825

[51] Int. Cl.[4] ..... D06F 33/02
[52] U.S. Cl. ..... 68/12 R; 68/23.4
[58] Field of Search ..... 68/12 R, 23 R, 23.4

[56] References Cited

U.S. PATENT DOCUMENTS 3,381,503 5/1968 Beck ..... 68/23 R X
4,184,347 1/1980 Tobita et al. ..... 68/12 R

*Primary Examiner*—Philip R. Coe
*Attorney, Agent, or Firm*—Darby & Darby

[57] ABSTRACT

A washing machine comprises an outer drum and an inner tub having water-expelling holes on its side wall. On the bottom of the inner tub, an agitator rotated intermittently by a motor is supported by means of bearings. An air trap is provided in communication with the gap between the outer and inner tubs. When the washing operation is started, the agitator is rotated and due to the pumping action of the agitator, the water level between the inner and outer tubs falls temporarily, which is detected by the pressure sensor connected to the air trap. The motor is deenergized according to the output from the pressure sensor and the agitator is stopped. Then the water level starts rising temporarily again thus the pressure sensor output is increased, which in turn energizes the motor and rotates the agitator. When such ON and OFF of the motor are repeated for more than the predetermined number of times, the washing operation will be completed. During the water-expelling process, the time required to obtain substantially constant changing rate of the pressure sensor output from the start of the water-expelling is measured. The energizing time and the braking timing of the motor for rotating the inner tub are controlled by the multiple of the measured time.

2 Claims, 20 Drawing Figures

WASHING MACHINE

This is a division of application Ser. No. 733,977, filed 5/14/85, now U.S. Pat. No. 4,662,193.

BACKGROUND OF THE INVENTION

1. Field of the Invention

The present invention relates to a washing machine. More specifically, the present invention relates to a full automatic washing machine capable of washing, rinsing or water-expelling in response to the quantity of the wash, that is, the load.

2. Description of the Prior Art

A washing machine which controls a state of water flow responding to the quantity of the wash is disclosed, for example, in Japanese Patent Publication No. 6519/1983 published on Feb. 4, 1983. In the prior art, a water level at an inner wall surface of a washing tub being changed in accordance with the state of water flow is detected by a level detecting means and is compared with the predetermined level, whereby a rotation of a motor for adjusting the water flow is controlled responding to the comparison.

However, in general, the water level in the washing machine changes in accordance with the state and quantity of the wash, accordingly if the changed water level is compared with the reference level set fixedly in advance as in the prior art described above, an accurate control may be not always possible. For exampole, when the wash are dried, they will suck water when soaked into the washing tub, in such case, the change of water level at the inner surface of the washing tub declines less than the set level, accordingly in the prior art, the optimum water flow according to the kinds and states of the wash is not always obtainable.

SUMMARY OF THE INVENTION

Therefore, it is a principal object of the present invention to provide a washing machine capable of generating an optimum water flow according to the load.

It is another object of the present invention to provide a washing machine, wherein a quiescent time or a rotating time of an agitator are adapted to be controlled automatically in accordance with the load.

It is a further object of the present invention to provide a washing machine capable of shortening the washing time.

The present invention is, in brief, a washing machine, wherein a water level in the washing tub changing in accordance with the quantity of wash, namely, the quantity of load, is detected and the intermittent rotation of an agitator is adapted to be controlled according to the change of water level.

According to the present invention, since the rotation or stop of the agitator is controlled in accordance with the quantity of change of the water level in the washing tube by detecting thereof, the more pertinent state of water flow may be set according to the quantity of wash, namely, the load as compared with the prior art mentioned above. In other words, according to the present invention, since the rotating time and the quiescent time of the agitator are controlled in accordance with the change of the water level by utilizing the facts that the larger the load, the longer the time required for the water level in the washing tub at the standstill and rotation of the agitator to change more than the predetermined level, the excessive washing can be avoided when the load is small and the sufficient washing may be accomplished when the load is large.

In the preferred embodiment of the present invention, when the repetition of the rotations and stops of the agitator exceeds the predetermined number of times, the motor is stopped and the washing or the rinsing process is completed. According to the preferred embodiment, since the washing or rinsing is controlled not by the time but by the repetition of the intermittent rotations and stops of the agitator, the time necessary for the washing or rinsing may be controlled automatically according to the quantity of wash, that is, the magnitude of load. Accordingly, the times required by each process can be shortened and the washing time may be reduced as a whole, as compared with the one having the respective time being set fixedly in advance.

In another preferred embodiment of the present invention, the washing tub is constituted by the double tubs, the outer and inner tubs, in which the water-expelling holes are disposed on the side wall of the latter and the water-expelling process may be accomplished by the rotation thereof.

In the water-expelling process, the pressure between the inner and outer tubs is detected by a pressure sensor and the time required for the changing rate of the pressure sensor output to become generally constant and stable is measured, whereby the energizing time or the braking timing of the motor are controlled based thereupon.

According to the preferred embodiment, when the load in the water-expelling process such as the quantity and the water content of the wash is small the water-expelling can be accomplished within a short time, while when the load is large the water-expelling may be performed relatively longer, accordingly the optimum water-expelling time may be set in response to the quantity and the water content of the wash.

Meanwhile, if the timing of the braking is controlled in accordance with the time mentioned above, an inertial rotating time of the inner tub can be controlled according to the magnitude of load such as the quantity and the water content of the wash, accordingly the braking can be applied at the optimum timing according to the load. Therefore, even when the load is large, since the braking is applied when the inertial force due to the intertial rotation of the inner tub has dropped below a certain level, according to the preferred embodiment, not only the noise will reduce but also the influence of the impact to the peripheral equipments at the braking can be restrained.

These objects and other objects, features, aspects and advantages of the present invention will become more apparent from the following detailed description of the embodiment of the present invention when taken in connection with the accompanying drawings.

DESCRIPTION OF THE PREFERRED EMBODIMENTS

Figure 1:
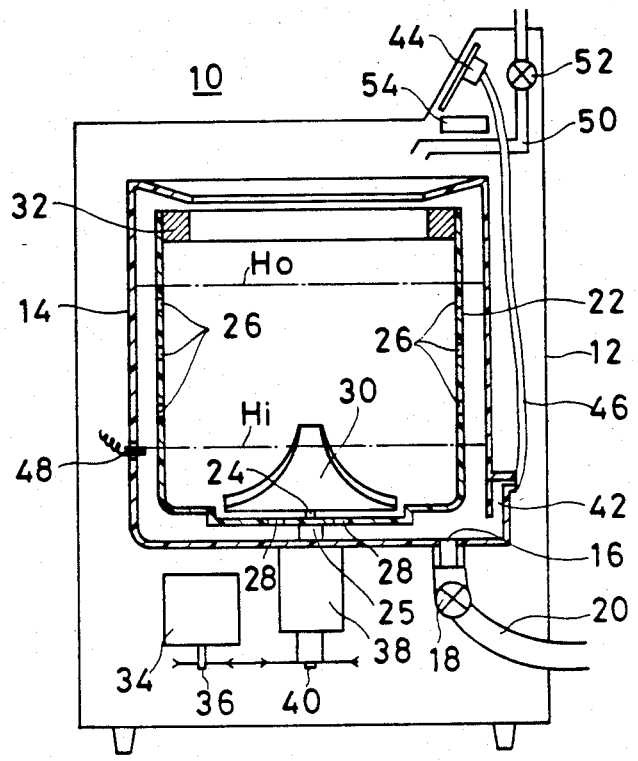
FIG. 1 is a sectional illustrative view showing an internal structure of an embodiment of the present invention.

FIG. 1 is a sectional illustrative view for explaining a structure fo an embodiment of the present invention. A washing machine 10 comprises a machine frame 12 in which an outer tub 14 is disposed fixedly. On the bottom of the outer tub 14 there is provided a drain outlet 16, to which a drain hose 20 is connected via an electromagnetic drainage valve 18. An end of the drain hose 20 is extending outwardly from the machine frame 12. Inside the outer tub 14 an inner tub 22 is supported rotatably by a rotary shaft 25. On the side and bottom walls of the inner tub 22 a plurality of water-expelling holes 26 and 28 are formed. Accordingly, the inner tub 22 is in communication with the outer tub 14 through the water-expelling holes 26 and 28. On the bottom of the inner tub 22 a pulsator or an agitator 30 connected to the rotary shaft 24 is provided. A balance ring 32 is mounted to the upper circumferential end of the inner tub 22. Thus, the outer and inner tubs 14 and 22 form the washing tub in cooperation and the inner tub 22 forms the water-expelling tub.

Inside the machine frame 12, a motor 34 is arranged underneath the outer tub 14 and an output shaft 36 of the motor 34 is connected to an input shaft 40 of a bearing case 38 via a transfer means such as a belt and the like. The bearing case 38 inc ludes a clutch mechanism disclosed, for example, in U.S. Pat. No. 3,267,703 and transfers the rotation given to the shaft 40 selectively to two rotary shafts 24 and 25 mentioned above via a suitable clutch and a reduction gear. That is, the clutch mechanism, not shown, connects the rotary shaft 24 to the input shaft for rotating the agitator 30 in the washing or the rinsing process and connects the rotary shaft 25 to the input shaft for rotating the inner tub 22 in the water-expelling process.

On the lower side wall of the outer tub 14, an air trap 42 is formed in communication with the gap between the outer and the inner tubs 14 and 22. The air trap 42 is connected to a semiconductor pressure sensor 44 via a hose 46. In the air trap 42, an air pressure therein changes in response to a water level between the outer and inner tubs 14 and 22, that is, the water level in the washing tub. The pressure change is conveyed to the semiconductor pressure sensor 44 through the hose 46. Accordingly, the semiconductor pressure sensor 44 is able to detect the variation or changing of the water level in the washing tub as the pressure change.

On the lower side wall of the outer tub 14, a pair of electrodes 48 spaced from each other are further mounted and start conduction via the water when the water is filled up to the level thereof. Accordingly, the pair of electrodes 48 serve as means for detecting whether the water is present above the predetermined level (Hi) in the washing tub or not.

Figure 4:
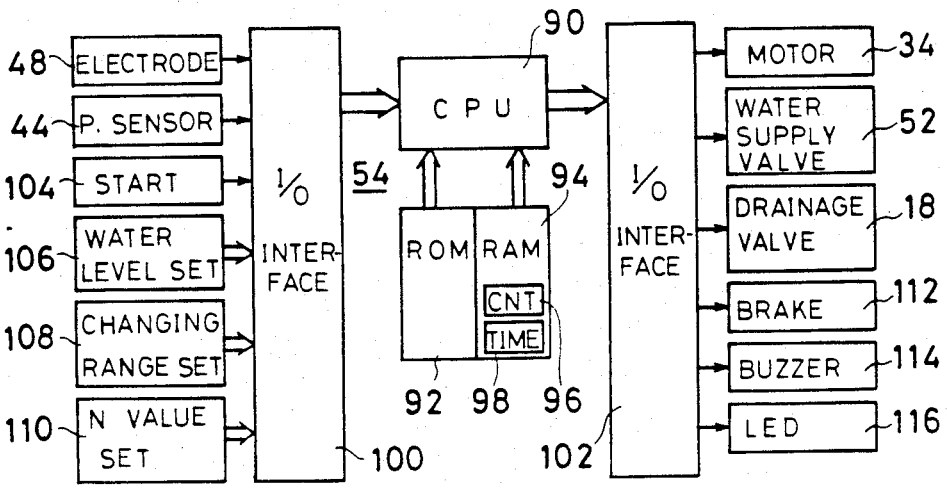
FIG. 4 is a schematic block diagram showing a control system of the embodiment.

Inside the upper portion of the machine frame 12, there is disposed a water supply pipe 50, which is provided with an electromagnetic water supply 52. The end of the water supply pipe 50 is positioned above the upper end of the washing tub, namely, the inner tub 22. Inside the upper portion of the machine frame 12, a controlling portion 54 containing a control system to be described later with reference to FIG. 4, is further disposed. In the embodiment, the controlling portion 54 controls the whole operations of the washing machine 10.

Figure 2:
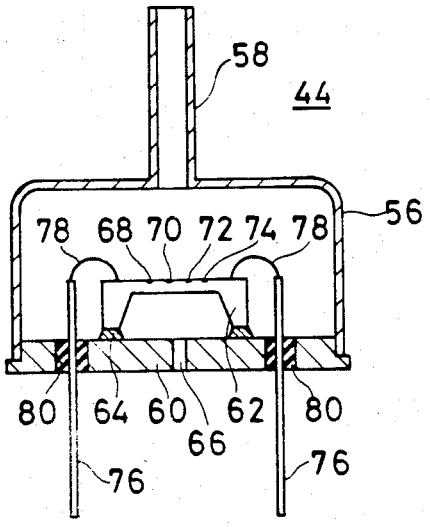
FIG. 2 is an illustrative view showing an example of a semiconductor pressure sensor used in the embodiment.
Figure 3:
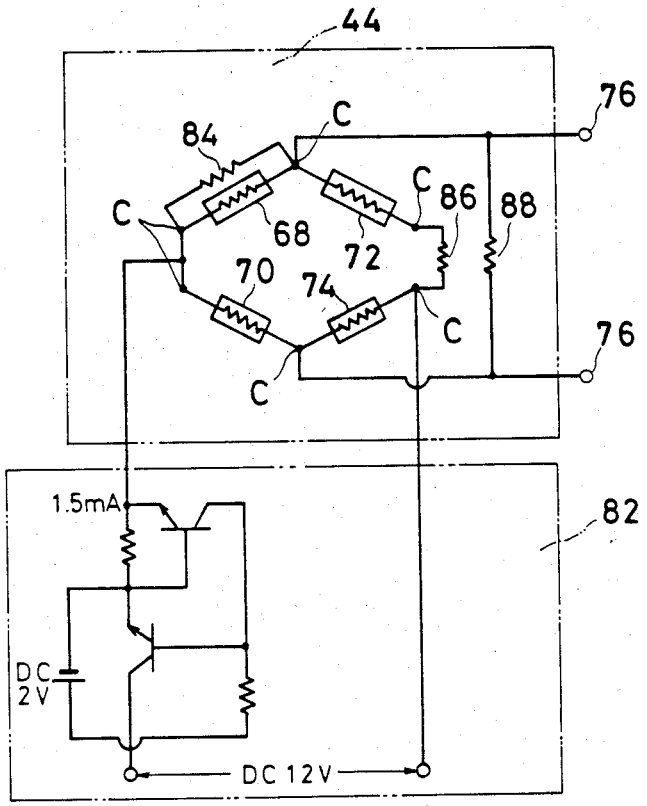
FIG. 3 is a circuit diagram showing pressure detecting circuits by a semiconductor pressure sensor.

Referring now to FIGS. 2 and 3, the semiconductor pressure sensor 44 and a pressure detecting circuit including thereof will be described. As the semiconductor pressure sensor 44, for example, the one disclosed in pages 40 through 48 in the Sanyo Technical Review Vol. 15, No. 1, Feb. 1983, may be used.

The semiconductor pressure sensor 44 comprises a cap 56, in which an introduction pipe 58 is formed on the upper surface thereof. Accordingly, an inner part of the cap 56 is in communication with the air trap 42 (FIG. 1) through the introduction pipe 58 and the hose 46 (FIG. 1). The bottom end of the cap 56 is sealed by a header 60. On the header 60 inside the cap 56 there is provided an arch-shaped silicon pellet 62, which legs are fixed to the upper surface of the header 60 by means of the adhesive 64. At substantially center portion of the header 60, an air hole 66 is formed, accordingly the silicon pellet 62 will serve as a diaphragm. On the flat upper surface of the silicon pellet 62, that is, on the diaphragm portion, four piezo diffusion resistance 68, 70, 72 and 74 are formed. These piezo diffusion resistance 68–74 are interconnected in bridge connection as shown in FIG. 3. The six connecting points (shown by "C" in FIG. 3) of the bridge connection are connected respectively to lead terminals 76 via lead wires 78. Moreover, each lead terminal 76 is secured to the header 60 via an insulator 80.

When the pressure inside the air trap 42 is passed into the cap 56 from the introduction pipe 58 through the hose 46, the diaphragm portion of the silicon pellet 62 will deform. Accordingly, the resistance valve of the piezo diffusion resistances 68–74 formed thereon will change. A constant-current source 82 is connected to these resistances 68–74 interconnected in bridge connection as shown in FIG. 3. Accordingly, the resistance change of these resistance 68–74 is taken out as the voltage change between the lead terminals 76. That is, as shown later in FIG. 5, the voltage responding to the pressure in the air trap 42, namely, the water level in the washing tub, is taken out to the output of the semiconductor pressure sensor 44.

Meanwhile, the resistances 84, 86, and 88 in FIG. 3 function respectively as resistances for the temperature compensation, the sensitivity adjustment and the zero point adjustment of the semiconductor pressure sensor 44.

FIG. 4 is a block diagram showing an example of the control system, in the embodiment, a CPU 90 controlling the whole operations of the washing machine 10 is provided in the controlling portion 54. As the CPU 90, for example, an integrated circuit "LM 6402" by Tokyo Sanyo Electric Co., Ltd. may be used. An ROM 92 for storing the control programs shown in each flow diagram to be described later and an RAM 94 for storing the information necessary for the control are connected to the CPU 90. In the RAM 94 a counter area 96, a timer area 98 and other suitable areas are formed. An I/O interfaces 100 and 102 are further connected to the CPU 90 respectively through the input and output ports thereof.

The output voltage from the semiconductor pressure sensor 44 as aforementioned is provided to the input interface 100 as is or after being converted into the digital signal as well as the signal from the electrode 48 shown in FIG. 1. A start button 104, although not shown, is provided on a control panel on the machine frame 12 (FIG. 1), from which a signal is given to the CPU 90 as a starting compound for the operation through the input interface 100. A setting switch 106 of the water level is provided on the control panel (not shown) as same as the start button 104. The water level setting switch 106 is used by an operator for setting the high or low water level in accordance with the quantity of the wash and according to the operation thereof, the data corresponding to the selected water level is provided to the CPU 90 through the interface 100. A setting portion 108 for the changing range is for setting the changing range of the output of the semiconductor pressure sensor 44 responding to the water level set by the water level setting switch 106 (to be described later in detail referring to FIGS. 14A and 14B). An N value setting portion 110 is used for setting the number of repetitions of the rotation and stop of the agitator 30 (FIG. 1) according to the set water level.

Figure 12:
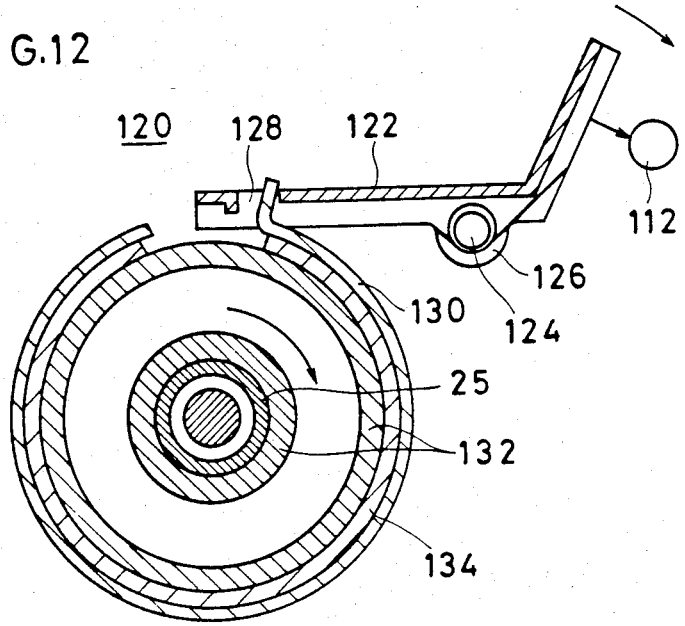
FIG. 12 is an illustrative view showing an example of a braking device.

The electromagnetic drain valve 18, the motor 34 and the electromagnetic water supply valve 52 previously mentioned are connected to the output interface 102. A solenoid 112 of a brake 120 as shown in FIG. 12 is connected to the output interface 102, and a buzzer 114 and a LED 116 provided at the suitable positions of the control panel on the machine frame 12 (FIG. 1) are further connected thereto. The buzzer 114 is used for warning, for example, a completion of the washing or an occurance of the abnormal states to the operator and the LED 116 is used, for example, for indicating that the washing machine is in operation.

The operation of the embodiment will be described in the following, firstly on the water supplying process in brief, referring to FIGS. 5 and 6.

Figure 5:
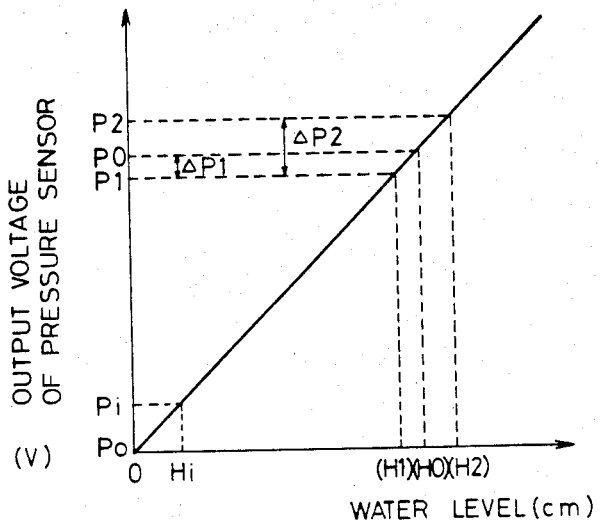
FIG. 5 is a graph showing a change of a semiconductor pressure sensor output relative to a change of a water level.

As shown in FIG. 5, the output voltage of the semiconductor pressure sensor 44 is generally in proportion to the water level in the washing tub. Now, when "P" represents the output voltage of the semiconductor pressure sensor 44 and "H" represents the water level, the equation "P=aH+b" is organized.

Let "Hi (Constant)" representing the position where the electrodes 48 shown in FIG. 1 is mounted, that is, the height of the electrodes 48 from the bottom of the outer tub 14, and setting "H0" as the water level at the completion of the water supply, the H0 can be represented by the equation "H0=m×Hi". However, an integer m is given as m=m] when the high water level has been set and m=m2 (m1<m2) when the low water level has been set.

The output of the semiconductor pressure sensor 44 is given as "Po" when the water level is zero. When the supplying of water starts thereafter and the water level reaches "Hi" the electrodes 48 aforementioned conduct through the water and then output "Pi" of the semiconductor pressure sensor 44 is applied. Thus, the output voltages "Po" and "Pi" of the semiconductor pressure sensor 44 are decided. Substitution of the output voltages Po and Pi into the equation mentioned above gives, $$Po = \frac{Pi - Po}{Hi} \times H + Po$$

In the meantime, substitution of "H=H0=m·Hi" into the foregoing equation gives the output P0 of the semiconductor sensor 44 at the water level H0. That is, the supplying of water is stopped when the output voltage of the semiconductor pressure sensor 44 becomes P0.

Figure 6:
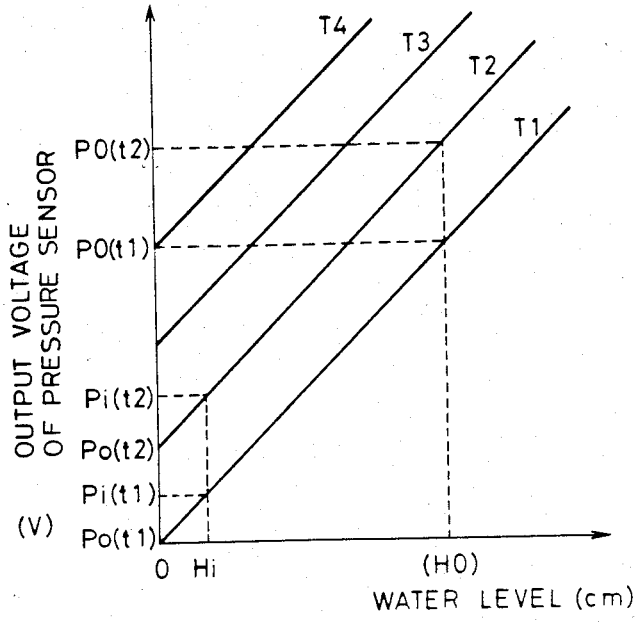
FIG. 6 is a graph corresponding to FIG. 5 as taking a temperature as a parameter.

Furthermore, the output voltage of the semiconductor pressure sensor 44 moves in parallel in response to the temperature t1 through t4 as shown in FIG. 6, if the temperatures are not compensated. However, since the setting of the water level based upon the equation mentioned above is made with calculating the setting value by detecting two points on the line representing the output characteristics thereof, and while the output characteristics is simply moved in parallel and the linearity thereof is not changed responding to the temperature, the setting of the water level H0 will not be hindered even if the temperature has changed.

For example, when the temperature is t2 the output P0 (t2) of the semiconductor pressure sensor 44 aforementioned may be given by the following equation, $$P0(t2) = \frac{Pi(t2) - Po(t2)}{Hi} \times H + Po(t2)$$

Thus, in the embodiment, with respect to the setting of the reference water level H0 the output of the semiconductor pressure sensor 44 does not need the temperature compensation. However, a sensibility of the semiconductor pressure sensor 44 is just required to be suitable adjusted by using the resistance 88.

Figure 7A:
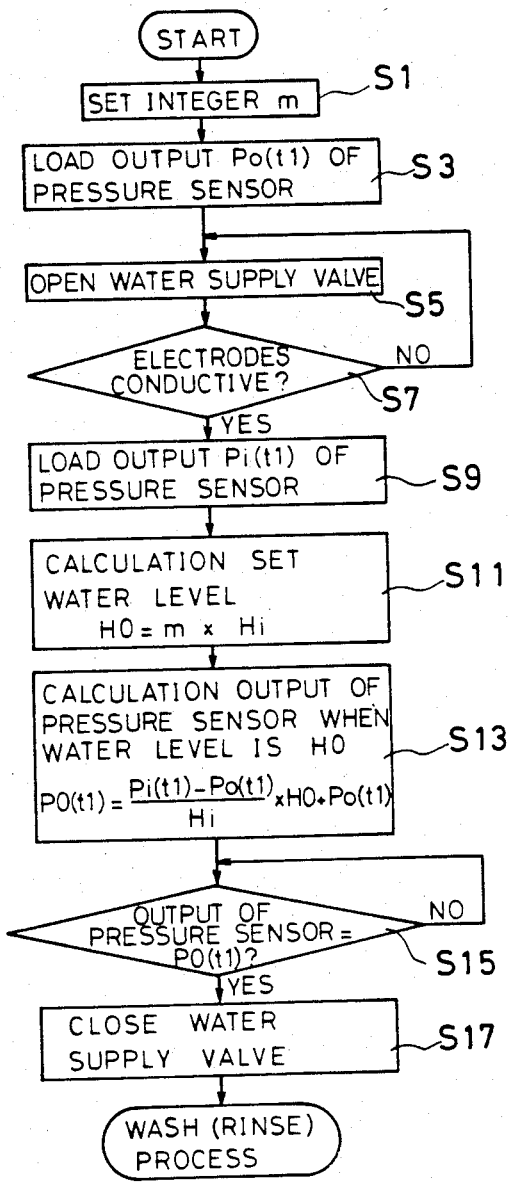
FIGS. 7(A) and 7(B) are flow diagrams for explaining the water supplying processes respectively at different temperatures.

Referring to FIG. 7(A), the water supply process at the temperature t1 will be described.

First, the operator has to select the high water level washing or the low water level washing by operating the water level setting switch 106 (FIG. 4). Accordingly, at the step S1, an integer m corresponding to the water level thereof is given to the CPU 90 from the water level setting switch 106 through the interface 100. Next, the CPU 90 loads the output Pi(t1) of the semiconductor pressure sensor 44 at the step S3 and gives the signal to the electromagnetic water supply valve 52 through the output interface 102 for opening the electromagnetic water supply valve 52 at the step S5. Accordingly, the electromagnetic water supply valve 52 is opened at the step S5 and the water is supplied to the washing tub through the water supply pipe 50.

The CPU 90 keeps the electromagnetic water supply valve 52 open till the signal from the electrodes 48 is fed through the interface 100. Then at the step S7, when the signal from the electrodes 48 is received the output Po(t1) of the semiconductor pressure sensor 44 is read into the CPU 90. Thereafter, the CPU 90 executes the steps S11 and S13 and calculates the then output Pi(t1) of the semiconductor pressure sensor 44 based upon the equation aforementioned.

When the output Po(t1) of the semiconductor pressure sensor 44 is received at the step S15, the CPU 90, at the next step S17, provides the signal to the electromagnetic water supply valve 52 through the interface 102. Therefore, the electromagnetic water supply valve 52 is closed at the step S17. In such a manner the water supply process is completed.

Figure 7B:
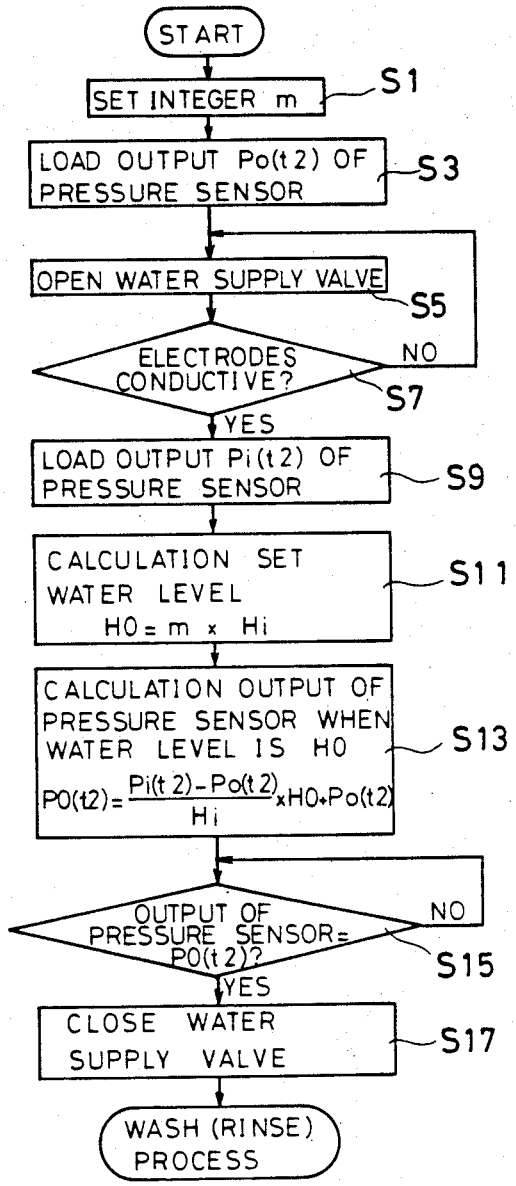

Meanwhile, a flow diagram in FIG. 7(B) is for the ambient temperature of t2 not of t1, wherein the steps S5, S9, S13 and S15 are different from FIG. 7(A). That is, at the step S5 the output of the semiconductor pressure sensor 44 is inputted to the CPU 90 as Po(t2), and at the step S9 it is fed as Pi(t2). The outputs Po(t2) and Pi(t2) are used in the calculation at the step S13. Then, at the step S15, it is determined whether the output of the semiconductor pressure sensor 44 has become P0(t2) or not. Meanwhile, a flow diagram for other steps is as same as FIG. 7(A), therefore, the duplicated description will be omitted here.

Now referring to FIG. 8 the washing or the rinsing process will be described roughly. The water level immediately after the completion of the water supply, namely, soon after the time period TP1 shown in FIG. 8 elapsed and the output of the semiconductor pressure sensor 44 corresponding thereto are stored, for example, in the predetermined area of the RAM 94 as H0 and P0.

Figure 8:
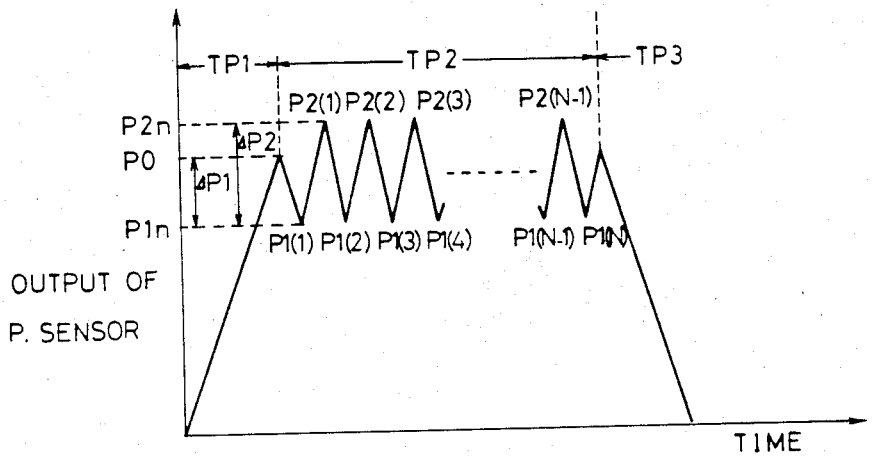
FIG. 8 is a graph showing an example of change of a semiconductor pressure sensor output relative to times in water supplying, washing or rinsing processes.

Thereafter, the washing or the rinsing process, that is, the time period TP2 shown in FIG. 8 will start. The agitator 30 is rotated intermittently in this process. For example, the agitator 30 is rotated during the time T1 and stopped during the time T2. The direction of rotation of the agitator 30 may be inverted at the alternate ON periods.

When the agitator 30 is rotating, water between the outer and the inner tubs 14 and 22 will be sucked into the inner tub 22 through the water-expelling holes 28 formed on the bottom of the inner tub 22 by the pumping action of the agitator 30. Therefore, the water level between the outer and the inner tubs 14 and 22 falls temporarily, which is transmitted to the semiconductor pressure sensor 44 through the air trap 42, consequently the output of the semiconductor pressure sensor 44 also decreases temporarily. Now, the output variation ΔP1 of the semiconductor pressure sensor 44 will be stored in the ROM 92 or the RAM 94 in advance.

When the agitator 30 is stopped water sucked previously into the inner tub 22 flows out through the water-expelling holes 26 and 28 and the water level between the outer and inner tubs 14 and 22 rises again by the reaction thereof, consequently the output of the semiconductor pressure sensor 44 also increases. Now, the output variation ΔP2 of the semiconductor pressure sensor 44 will be stored in the ROM 92 or the RAM 94 in advance.

Then, in the embodiment, the rotating time and the stopping time of the motor 34, namely, the agitator 30 is controlled by detecting such output changing ranges ΔP1 and ΔP2. Thus, the agitator 30 is rotated intermittently in the washing or the rinsing process. Now, in the embodiment, the time of such washing or rinsing process is controlled by the number of repetitions of the intermittent rotation and stop of the agitator 30. That is, in the embodiment, a counter area 96 is provided in the RAM 94 (FIG. 4), wherein the number of energizings of the agitator 30, namely, the motor 34 is counted. Then the CPU 90 stops the power supply to the motor 34 when the counted value of the counter 96 reaches the set value N.

Figure 9:
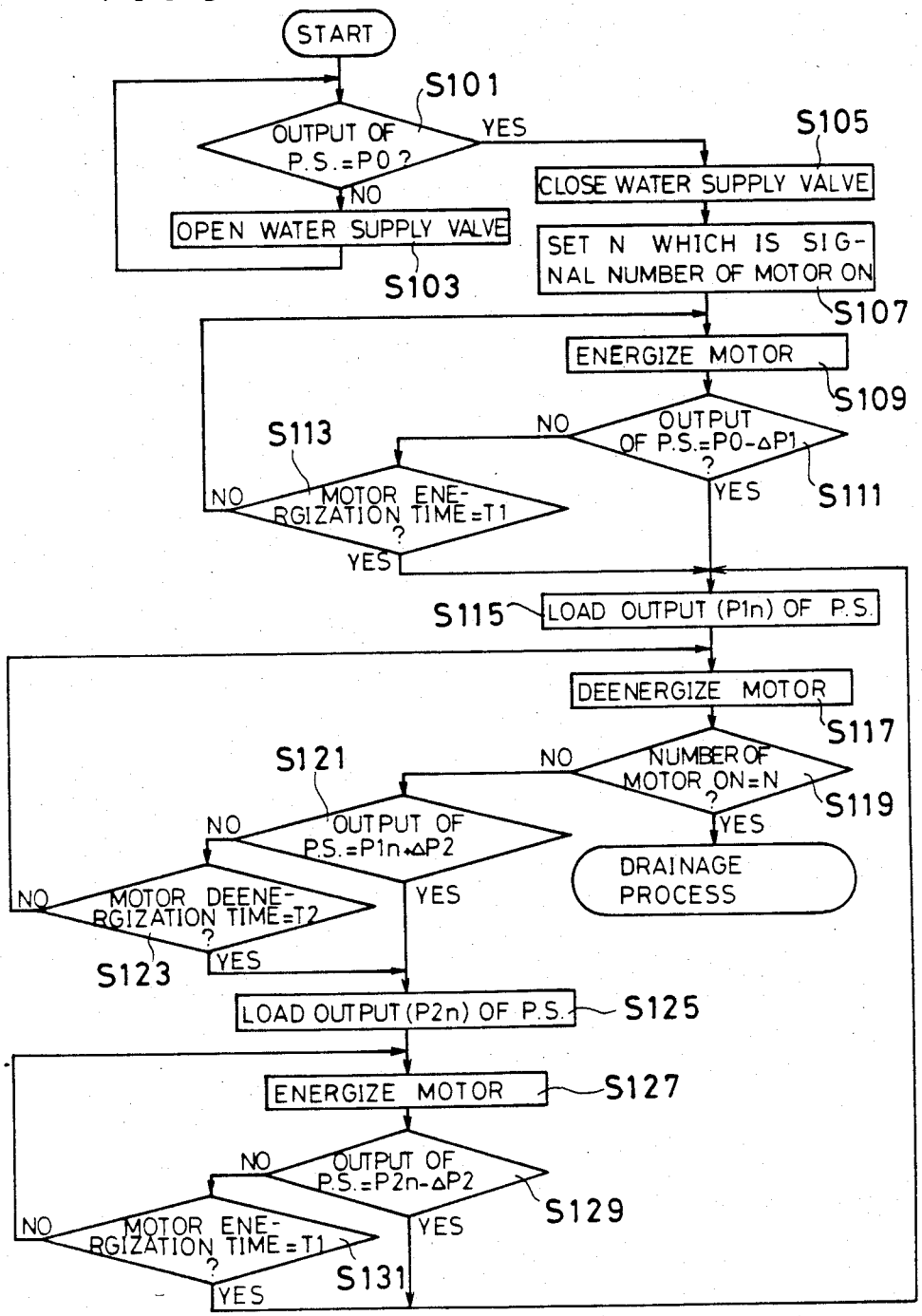
FIG. 9 is a flow diagram for explaining a washing or a rinsing process.

Referring to FIG. 9, the washing or the rinsing process of the embodiment will be described in detail. In the first step S101, the CPU 90 determines whether the output of the semiconductor pressure sensor 44 is "P0" or not. That is, in the step S101 it is determined whether the water level in the washing tub is above the set water level H0 or not. Accordingly, if the water level is below the set water level H0 then the CPU 90 gives the signal to the electromagnetic water supply valve 52 through the interface 102. Consequently, the electromagnetic water supply valve 52 is opened at the step S103 and the water is supplied.

Now, when the output of the semiconductor pressure sensor 44 reaches P0, the CPU 90 gives the signal for closing the electromagnetic water supply valve 52 to the interface 102 at the step S105. Consequently, the electromagnetic water supply valve 52 is closed at the steps S105. Thereafter, the operator will supply the wash into the inner tub 22 after charging the detergents when washing or as is when rinsing.

At the step S107, the N value set by the setting portion 110 according to the water level (high or low) being set previously by the operator, is stored in the RAM 94 and the time of washing or rinsing described above, that is, the number of repetitions of energizing and deenergizing the motor 34 is set. Successively, the CPU 90 gives the drive signal to the motor 34 through the interface 102 and the motor 34 is energized as the step S109. Then the agitator 30 starts rotating and as previously mentioned, the output from the semiconductor pressure sensor 44 begins to decrease. Thereafter, the CPU 90 decides the timing for turning off the motor 34 at the steps S111 or S113 based upon the output of the semiconductor pressure sensor 44 or the time in the timer area 98 of the RAM 94. More specifically, at the step S111, the CPU 90 determines whether or not the output of the semiconductor pressure sensor 44 has decreased by the variable range ΔP1 (FIG. 8) being set previously from the initial state P0, namely, the output P of the semiconductor pressure sensor 44 has become "P=P0−ΔP1". Then, if it is determined "NO" at the step S111, the CPU 90 determines whether or not the time T1 previously set has elapsed after the motor 34 being energized at the next step S113 referring to the time counted by the timer 98 (FIG. 4).

In such a manner, when either of the conditions at the steps S111 or S113 is satisfied, the CPU 90 stores the output of the semiconductor pressure sensor 44 as "P1n (n=1,2,3 . . . ,N)", for example, in the predetermined area of the RAM 94. Then the CPU 90 gives the signal to the output interface 102 and deenergizes the motor 34.

The CPU 90 determines whether or not the number of repetitions of the energization or deenergization of the motor 34 has reached the value N (read in at the previous step S107) set by the N value setting portion 110 previously mentioned, at the next step S119 by reading the counted value of the counter 96 in the RAM 94. Then, if the number of repetitions of ON and OFF of the motor 34 has reached N times, the next drainage process will follow. In the reverse case, the washing or the rinsing will be continued.

When the motor 34 is turned off at the previous step S117, the agitator 30 will be stopped, Then, the output of the semiconductor pressure sensor 44 begins to increase as previously described. Now, when it is determined "NO" at the previous step S119, that is, if it is determined that the number of repetition of ON and OFF of the motor 34 has not reached the set value N, the CPU 90 determines whether or not the output of the semiconductor pressure sensor 44 has increased from the output P1 stored at the previous step S115 by the variable range ΔP2 (FIG. 2) being set previously. Then, when it is determined "NO" at the step S121, the CPU 90 determines whether or not the time T2 previously set has elapsed after the motor 34 being denergized at the next step S123 referring to the timer 98 of the RAM 94. More specifically, the CPU 90 has determined whether or not the output of the semiconductor pressure sensor 44 has increased more than the predetermined value ΔP2 with the turning off of the motor 34 or the denergizing time of the motor 34 has past more than the predetermined time T2 at the steps S121 and S123.

When the conditions at the steps S121 and S123 are satisfied, the CPU 90 stores the then output of the semiconductor pressure sensor 44 as "P2N (n=1, 2, . . . , N−1)" in the predetermined area of the RAM 94 at the next step S125.

Now, the CPU 90 gives the signal again to the interface 102 and energizes the motor at the step S127. When the motor 34 is energized the agitator 30 starts rotating again and the output of the semiconductor pressure sensor 44 begins to decrease as previously described. Then, the CPU 90 determines whether or not the output of the semiconductor pressure sensor 44 has decreased from the output P2n stored at the previous step S125 by the variable range ΔP2 being set previously at the step S129. More specifically, the CPU 90 determines whether or not the output (P1) at the previous step S115 has been reached at the step S129 based upon the output (P2) of the semiconductor pressure sensor 44 at immediately before, If it is determined "NO" at the step S129, whether the time T1 has elapsed or not is determined as same as the previous step S113. When either of the conditions at the steps S129 or S131 is satisfied the process is returned to the previous step S115 again and the steps S115 through S131 are repeated. In such a manner, the energization or deenergization of the motor 34, namely, the rotation and stop of the agitator 30 are repeated thereafter. Then, if the number of repetions thereof reaches the set value N, the drainage process will follow through the previous step S119.

Thus, according to the embodiment, the energizing time of the motor 34, that is, the rotating time of the agitator 30 is controlled according to the magnitude of load, namely, the quantity of the wash. More specifically, the semiconductor pressure sensor 44 has detected the change of the water level between the outer and the inner tabs 14 and 22, while the motor 34 is energized or deenergized in response to the changes ΔP1 and ΔP2 of the output of the semiconductor pressure sensor 44 as at the steps S111, S121 or S129. Accordingly, for example, when the quantity of the wash is small the rotating speed of the agitator 30 is high because of the small resistance, and the falling speed of the water level between the outer and inner tubs 14 and 22, that is, the time for the output of the semiconductor pressure sensor 44 to decrease by the predetermined variation range ΔP1 (or ΔP2) is fast. Therefore, the energizing time of the motor 34 is shortened. On the contrary, when the load is large, the rotating speed of the agitator 30 will decrease because of the large resistance. Accordingly, since the time for the output of the semiconductor pressure sensor 44 to decrease by the predetermined variation range Δ2 is slow, consequently the energizing time of the motor 34 is prolonged. Thus, if the rotating time of the motor 34, namely, the agitator 30 is adapted to be controlled according to the magnitude of load, since the movement of the wash will deteriorate when the load is large, the washing performance can be maintained by extending the rotating time of the agitator 30, while when the load is small since the movement of the wash will be improved, the occurrence of damages or creases of the wash can be restrained by shortening the energizing time of the motor 34.

The inventor has performed an experiment in order to judge the quality of the washing performances. The results show the experiment where the washing was performed on the quantity of the wash, namely, the loads of 3 kg. and 1 kg. respectively for 10 minutes. The water level was kept at the "high level" for both cases.

TABLE 1

| | | | |
|---|---|---|---|
| A | Load (Kg.) | 3.0 | 1.0 |
| B | Rotating Time of Agitator/Quiescent Time | 2/1 | 1/1 |
| C | Rotating Speed of Agitator (rps) | 1.76 | 1.94 |
| D | Rotating Time during 10 minutes (sec.) | 400 | 300 |
| E | Number of Rotations of Agitator (Time) | 704 | 582 |
| F | Number of Rotations of Agitator per 1 Kg. load (") | 235 | 582 |

From the result of Table 1, in particular, as is clearly seen in items D and F, the washing performance is apparently high with the small load when the washing time is fixed. In other words, the washing performance varies with the magnitude of load when the washing time is fixed, for example, as 10 minutes.

Now, in the embodiment in FIG. 9, the completion of the washing is adapted to be controlled not by the washing time but by the number of repetitions of the rotation and the stop of the agitator 30 by providing the step S119. In this arrangement, although the rotating time of the agitator 30 varies in accordance with the load as aforementioned, since the washing performance per one repetition of the rotation and the stop of the agitator 30 is equal, the washing can be completed in a short time when the quantity is small and relatively in a long time when the quantity is large, consequently the uniform washing performances may be obtained regardless of the magnitudes of the loads. Meanwhile, the count of the number N of repetitions can be substituted by counting the number of OFF signals of the motor 34 from the CPU 90, besides counting the number of ON signals thereof as described above.

Moreover, the variation ranges ΔP1 and ΔP2 aforementioned are required to be set as such that splashes and so on will not occur even when the water level in the washing tub varies as much as the level corresponding to such variation ranges of the output of the semiconductor pressure sensor 44. Furthermore, the maximum values of the ON and OFF time T1 and T2 of the motor 34 are required to be set as such that the sufficient washing can be accomplished even when the load is large, that is, the quantity of the wash is large.

Now, set values ΔP1 and ΔP2, T1, T2 and N mentioned above may be changed with the water level filled in the washing tub or with each process such as the washing or the rinsing with standing water or with flowing water, as necessary, for example, by the constant multiplication of these set values.

Figure 10:
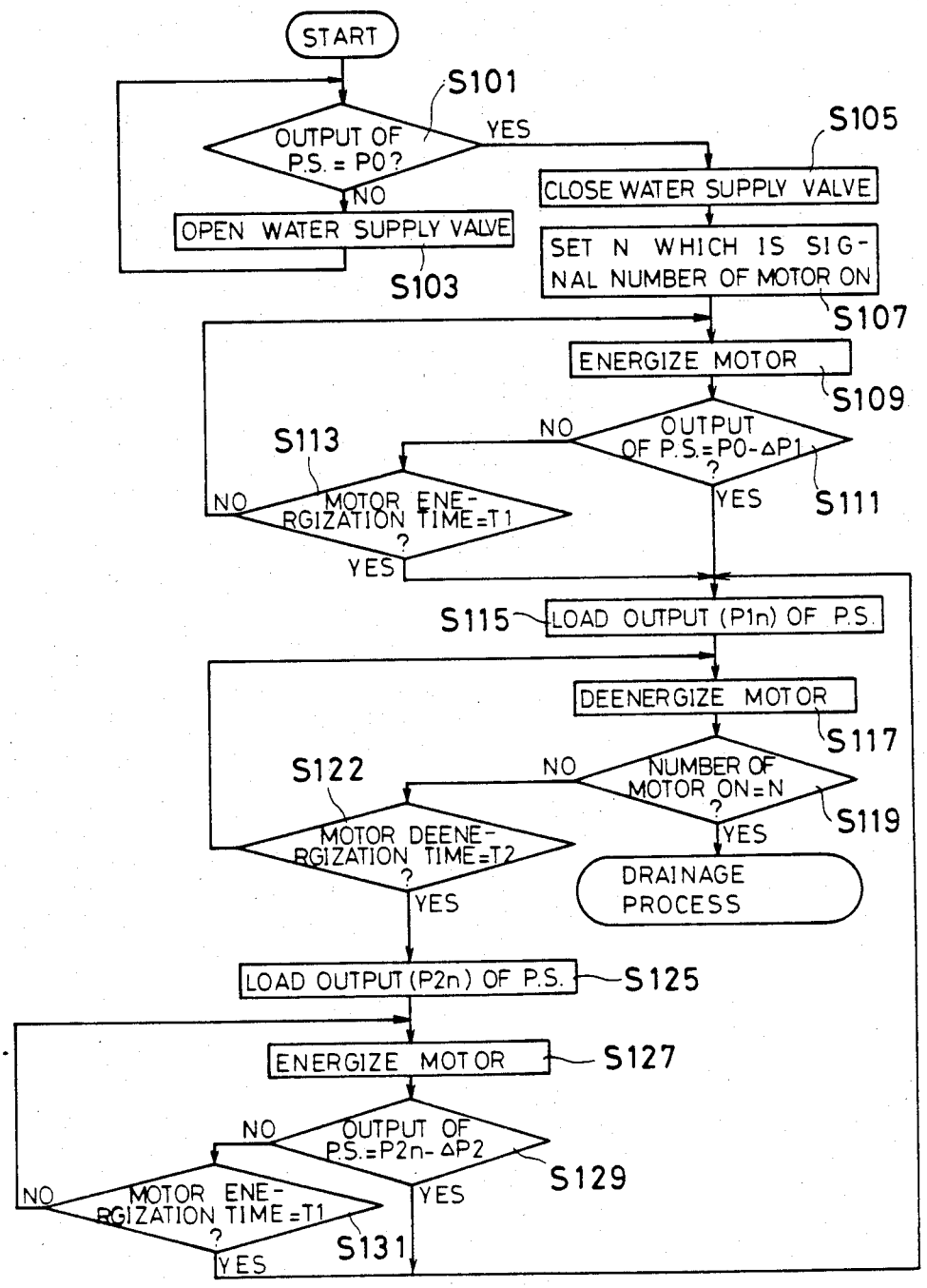
FIG. 10 is a flow diagram for explaining another example of a washing or a rinsing process.

FIG. 10 is a flow diagram for explaining another embodiment of the present invention. In the embodiment in FIG. 9, the change of the output of the semiconductor pressure sensor 44 above the predetermined value ΔP2 or the lapse of time T2 were decided as the conditions for deciding the timing to energize the motor 34. However, the variation range ΔP2 for re-energization of the motor 34 of the output of the semiconductor pressure sensor 44 is not needed to be set particularly, but only the fixed time T may be used for the control. Toward this end, in the embodiment in FIG. 10, the step S122 is provided in substitution for the previous steps S121 and S123. At the step S122, the CPU 90 determines whether or not the time T has past after the motor 34 is turned off at the step S117 referring to the timer 98. Then, if the time T has elapsed the motor 34 is energized again.

In the meantime, other steps in the flow diagram in FIG. 10 are as same as in FIG. 9, so the duplicated description thereof will be omitted here.

When the washing or the rinsing process is completed, that is, when the period TP2 shown in FIG. 8 is ended, the drainage process will follow as shown in the step S119 in FIGS. 9 and 10.

Now referring to FIG. 11 the drainage process will be described. The water level in the washing tub falls as the drainage proceeds, accordingly an air pressure inside the air trap 42 (FIG. 1) reduces and also the output of the semiconductor pressure sensor 44 decreases (refer to time period TP3 in FIG. 11). Then, when the water level falls to the fixed level, that is, the output of the semiconductor pressure sensor 44 decreases to the value Pd being set previously, the inner tub 22 is rotated by the motor 34 and the water-expelling process is started.

Figure 11:
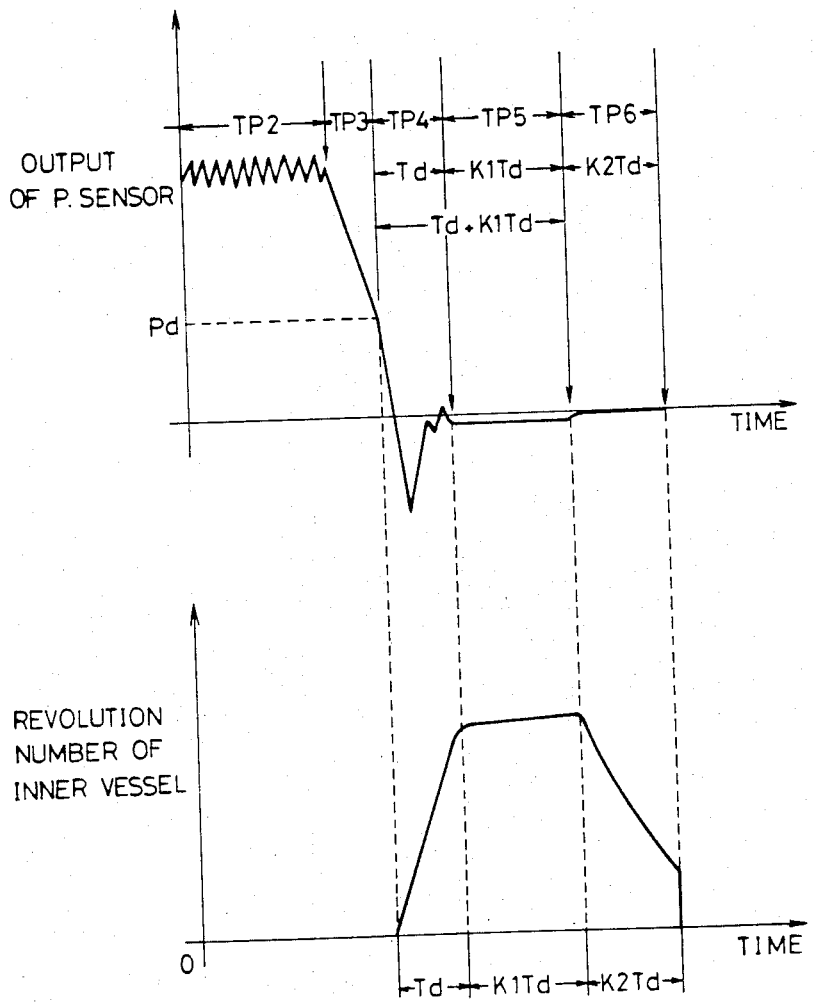
FIG. 11 is a graph showing an example of change of a semiconductor pressure sensor output and change of the number of rotations of a motor in a water-expelling process.

Since the water still remains in the inner tub 22 immediately after the start of the water-expelling, the output of the semiconductor pressure sensor 44 fluctuates as shown in the time period TP4 in FIG. 11. Then, when the water level reaches generally zero and the rotation of the inner tub or the water-expelling tub 22 is stabilized, the output of the semiconductor pressure sensor 44 stabilizes as shown in the time period TP5 in FIG. 11. More specifically, in the period TP5, if the changing rate Z of the output of the semiconductor pressure sensor 44 is expressed as $Z=dP/dt$ (wherein P represents an output voltage of the semiconductor pressure sensor 44 and t represents the time) then $Za<Z<Zb$.

The time for the changing rate Z to reach the stabilized predetermined range after the output of the semiconductor pressure sensor 44 has reached the predetermined value Pd, that is, the time of the period TP4 shown in FIG. 11 is represented by "Td". Then, in the embodiment, the energizing time of the motor 34 and the braking timing to the inner tub 22 in the water-expelling process are controlled based upon the time Td. That is, the time Td and the constant K1 are multiplied and the energizing of the motor 34 thereafter is continued for the time Td multiplied by K1 (refer to the time period TP5 in FIG. 11). Now, the time Td and the constant K2 are multiplied after the motor 34 being deenergized and when just the time Td multiplied by K2 has elapsed thereafter, the braking is applied to the inner tub 22. In such a manner, the number of rotations of the motor 34, namely, the inner tub 22 changes as shown in FIG. 11(B).

In the embodiment, viewing the fact that the time Td is the time for the output of the semiconductor pressure sensor 44 to fluctuate by the water discharged from the wash in the water-expelling process and the larger the load, that is, the more the water content the longer the time, the water-expelling time is decided based upon the time Td. Therefore, according to the embodiment the water-expelling in accordance with the load may be accomplished.

Furthermore, the inner tub 22 continues to rotate by inertia even after the motor 34 is deenergized and the larger the load, the stronger the inertial force. Accordingly, if the braking is applied to the inner tub 22 after the fixed time regardless of themagnitude of load, since the inertial force increases when the load is large, the noise or the large vibration will be generated, but if the brake timing is decided based upon the time Td aforementioned as in the embodiment, since the braking will be applied when the inertial force is reduced substantially regardless of the magnitude of the load, such problems can be avoided.

Referring to FIG. 12, a structure of the brake device will be described. The brake 120 includes a brake lever 122, which is supported rotatably by an axis 124. Then, there is provided a spring 126 on the axis 124, accordingly the brake lever 122 is normally inclined in a reverse direction of the direction shown by the arrow in FIG. 12. On the other hand, when the brake 120 being deactivated the solenoid 112 is energized and pulling the lever 122 the direction of the arrow. When operating the brake 120, the solenoid 112 is deenergized and the brake lever 122 at one end is pressured toward the direction of the arrow by the spring 126. A penetrating hole 128 is formed on an opposite end of the brake lever 122, which engages with an end of a receiving member 130 when the solenoid 112 is deenergized and the lever 122 is operated. The receiving member 130 is winded to a brake wheel 132 fixed to the shaft 25 in the bearing case 38 (FIG. 8) via a brake lining 134.

When the inner tub 22 is rotated and the water-expelling operation is performed, the brake lever 122 is pivoted toward the direction of arrow by the solenoid 112. Accordingly, the penetrating hole 128 and the receiving member 130 are in disengagement and the receiving member 130 is being rotated together with the shaft 25. Then, if the solenoid 112 is deenergized when applying the brake, the brake lever 122 is pivoted in the opposite direction of the arrow by the spring 126. Accordingly, the penetrating hole 128 engages with the end of the receiving member 130 and the rotation thereof is stopped and the brake wheel 132 is tighten by the brake lining 134, thus allowing the braking of the shaft 25, namely, the inner tub 22 by the friction thereof.

Meanwhile, a solenoid for the electromagnetic drainage valve 18 may have a configuration used commonly as the brake solenoid 112.

Figure 13:
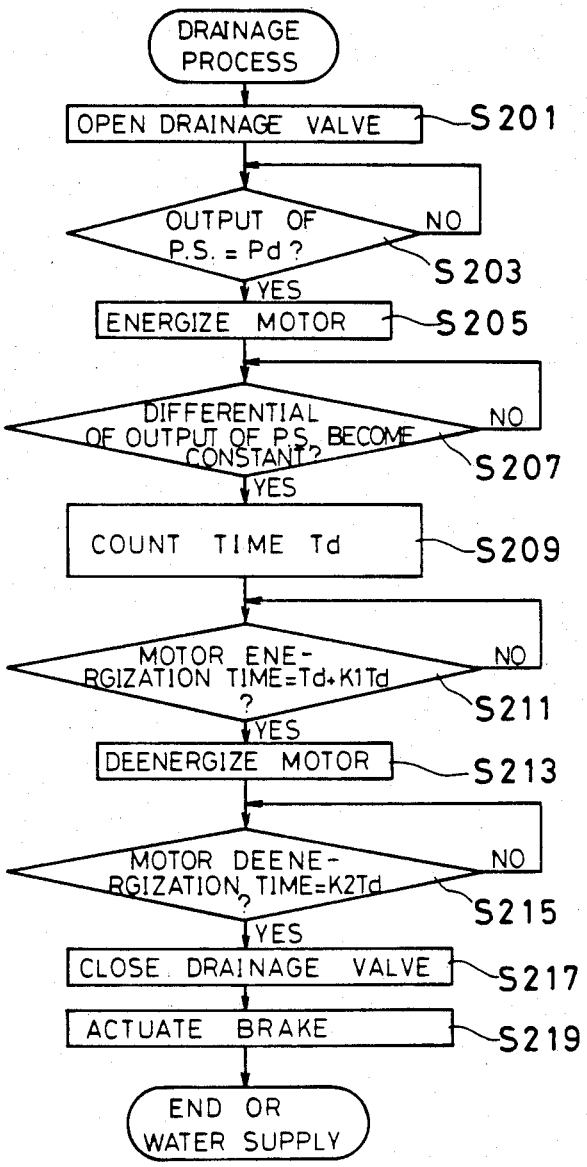
FIG. 13 is a flow diagram for explaining a water-expelling process.

Referring to FIG. 13, the water-expelling process will be described in detail. The CPU 90 gives the signal to the interface 102 and opens the electromagnetic drainage valve 18 at the first step S201. Accordingly, water filled in the washing tub is drained outside the machine frame 12 through the drain hose 20 and the air pressure in the air trap 42 (FIG. 1) will reduce. Therefore, the output of the semiconductor pressure sensor 44 also decreases as shown by the time period TP3 in FIG. 11. Then, when the CPU 90 detects that the output of the semiconductor pressure sensor 44 has decreased to the predetermined value Pd at the step S203, it gives the signal to the motor 34 via the interface 102 at the next step S205. At this time, a clutch mechanism in the bearing case 38 (FIG. 1) is being changed over and the rotary shaft 25 connected to the inner tub 22 is being activated. When the motor 34 is turned on, therefore, the rotary shaft 25 is rotated and the inner tub 22 will be rotated, thus water contained int he wash in the inner tub 22 is expelled out through the water-expelling holes 26 and 28 formed on the inner tub 22. Accordingly, the water level between the outer and inner tubs 14 and 22 will change. That is, in the initial stage of the water-expelling process, the air pressure in the air trap 42 changes gradually due to the water discharged from the inner tub 22, thus the output of the semiconductor pressure sensor 44 also changes considerably as shown by the time period TP3 in FIG. 11.

Thereafter, when the CPU 90 detects that the changing rate Z of the output of the semiconductor pressure sensor 44 has reached the predetermined range at the step S207, that is, when the stabilized operation in the water-expelling process is detected, the CPU 90 reads the time Td for the changing rate Z to become substantially constant as such, from the timer area 98 of the RAM 94 at the next step S209. Then, the time "K1Td" is calculated by multiplying the time Td by the constant K1 being set previously, for example, in the ROM 92.

The CPU 90 determines whether the time "Td+K1Td" has elapsed or not after the motor 34 is energized at the next step S211. Then, if it is determined "YES" at the step S211, that is, when the time period TP4 in FIG. 11 has elapsed, the CPU 90 deenergizes the motor 34 at the next step S213.

The inner tub 22 continues to rotate by the inertia even after the motor 34 has been deenergized as shown by the time period TP6 in FIG. 11. Now, the CPU 90 calculates the time "K2Td" by multiplying the time Td by the constant K2. Then, the CPU 90 determines whether the time "K2Td" has elapsed or not after the motor 34 is turned off at step S215. When the time "K2Td" has elapsed after the motor 34 was turned off, then the CPU 90 closes the electromagnetic drainage valve 18 at the step S217 and simultaneously denergizes the solenoid 112 and actuates the brake 120 at step S217. The timing thereof is at the end of the time period TP6 in FIG. 11.

In the embodiment, the rotating duration and the brake timing of the inner tub 22 is the water-expelling process are controlled in based upon the time Td, namely, the magnitude of load. Accordingly, the optimum water-expelling process according to the load may be accomplished.

Figure 14A:
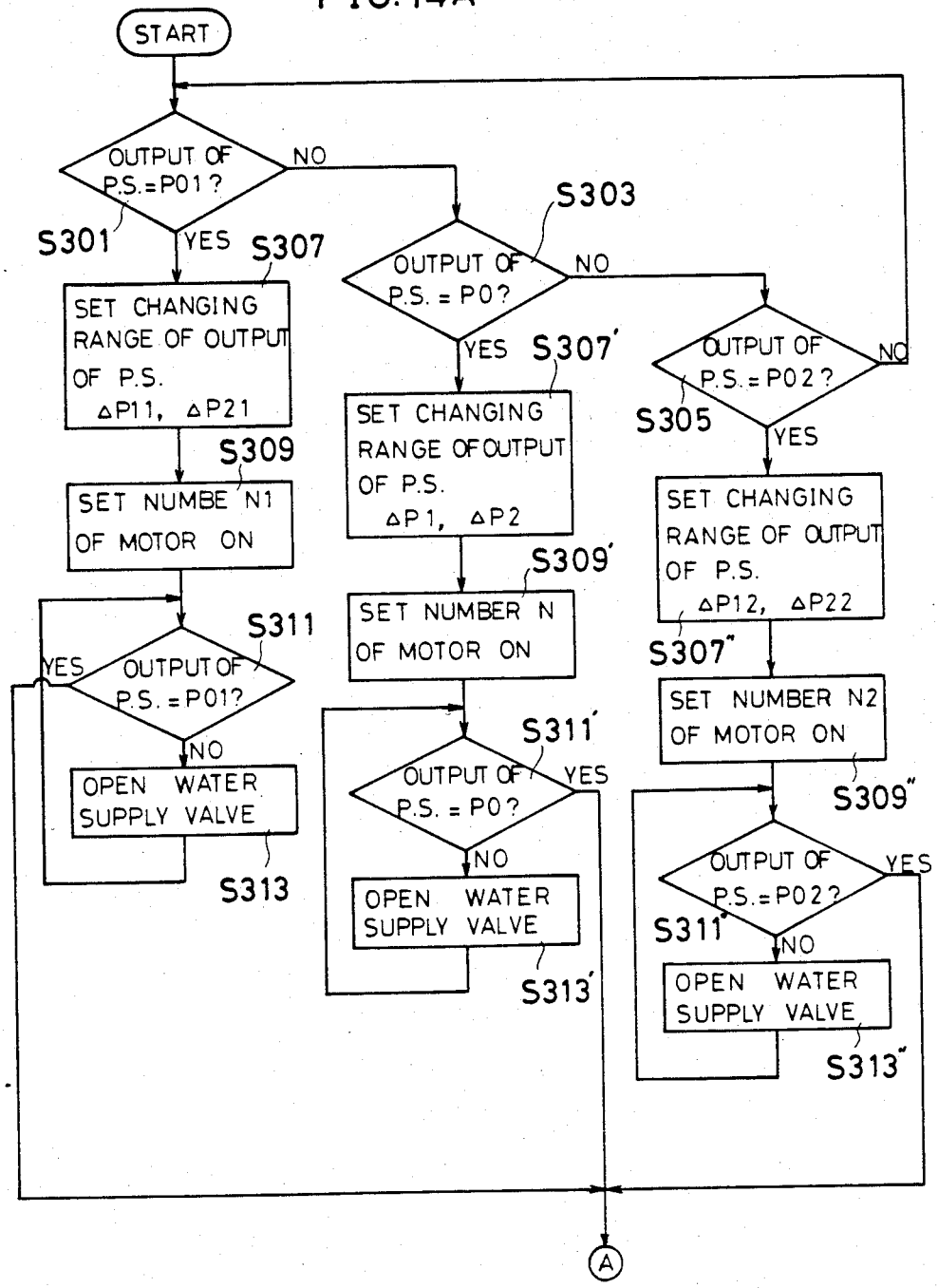
FIGS. 14(A) and 14(B) are flow diagrams for explaining another example of a washing or a rinsing process.
Figure 14B:
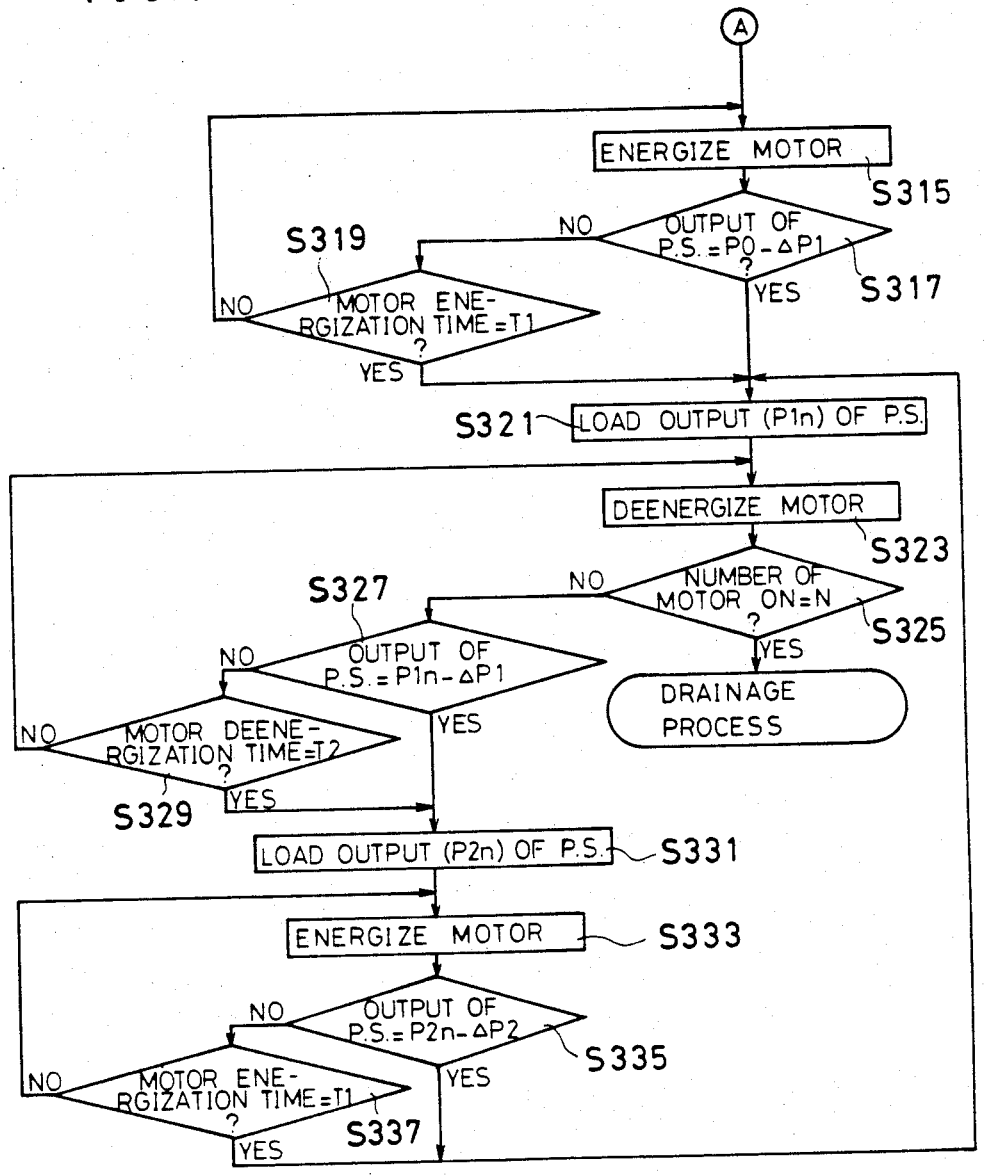

FIGS. 14A and 14B are flow diagrams for explaining another embodiment of the present invention. In the previous embodiment in FIG. 9, the variation ranges ΔP1 and ΔP2 of the output for controlling ON and OFF of the motor 34 were constant regardless of the water level set by the water level setting switch 106 (FIG. 4). The variation ranges ΔP1 and ΔP2 of the output are set relatively large as such that even when the quantity of the wash is large and the high water level is set, the sufficient washing performance can be obtained relative to such load as previously described. However, when the water level is low the quantity of water and the wash is small, accordingly the load is small and the agitator 30 is in readily rotatable state. Nevertheless, if the same variation ranges ΔP1 and ΔP2 as the high water level are applied, an excessive washing performance will be caused and the wash will be damaged or tangled.

Now, in the embodiment shown in FIGS. 14A and 14B, the variation ranges ΔP1 and ΔP2 and the number of repetitions N of the rotation and stop of the agitator 30 are adapted to be set corresponding to the water level set by the water level setting switch 106 as shown in Table 2.

TABLE 2

| | High Level | Standard Level | Low Level |
|---|---|---|---|
| Output of Pressure Sensor | P01 | P0 | P02 |
| Variable Range of Output | ΔP11, ΔP21 | ΔP1, ΔP2 | ΔP12, ΔP22 |
| Number of Repetitions | N1 | N | N2 |

Provided, P01<P0<P02, ΔP11>ΔP1>ΔP21, ΔP21>ΔP2>ΔP22 and N1>N>N2.

Now, in the embodiment, the control is performed as same as in the embodiment in FIG. 9 by selecting the set values responding to the water level set, as shown in FIGS. 14A and 14B.

In FIG. 14A, the CPU 90 determines whether the water level selected by the operator is high or standard or low, based upon the output from the semiconductor pressure sensor 44 at the steps S301, S303 or S305. Then, when the water level is high the steps following the step S301 are executed, when thelevel is standard the steps following the step S303 are performed and the steps next to the step S305 are executed when the level is low.

At the steps S307 and S309, the set values ΔP11, ΔP21 and N1 for the high water level are read out, for example, from the ROM 92 and stored in the predetermined area of the RAM 94. Thereafter, the steps S311 and S313 are executed. The steps S311 and S313 are corresponding respectively to the steps S101 and S103 in FIG. 9.

When it is determined that the standard water level has been selected at the step S303, the set values ΔP1, ΔP2 and N aforementioned are read out from the ROM 92 and stored in the RAM 94 at the steps S307′ and S309′.

After the step S305, steps S307″ and S309″ are executed and the set values ΔP21, ΔP22 and N2 for the low water level are stored in the RAM 94.

Then, after the step S311 (or S311′ or S311″) the step shown in FIG. 14B will follow. The each step after the step S315 shown in FIG. 14B is as same as the each step after the step S109 in FIG. 9, so the detailed description thereof will be omitted.

In the embodiment shown in FIGS. 14A and 14B, since the variation range ΔP1 and ΔP2 of the output are adapted to be changed in response to the water level set by the operator, the optimum state of water flow may be generated corresponding to such water level.

Figure 15A:
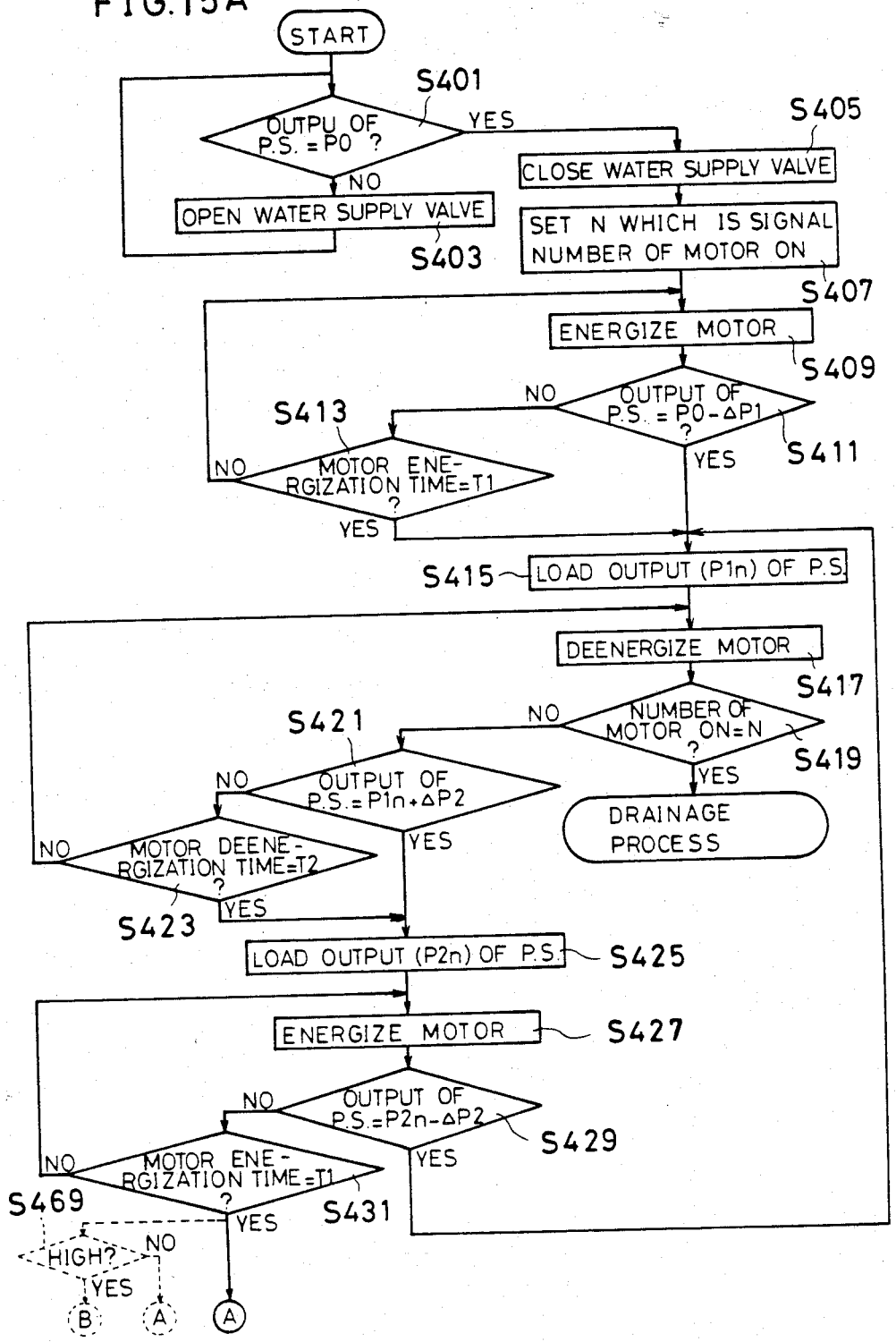
FIGS. 15(A) and 15(B) are flow diagrams for explaining further another example of a washing and a rinsing process.
Figure 15B:
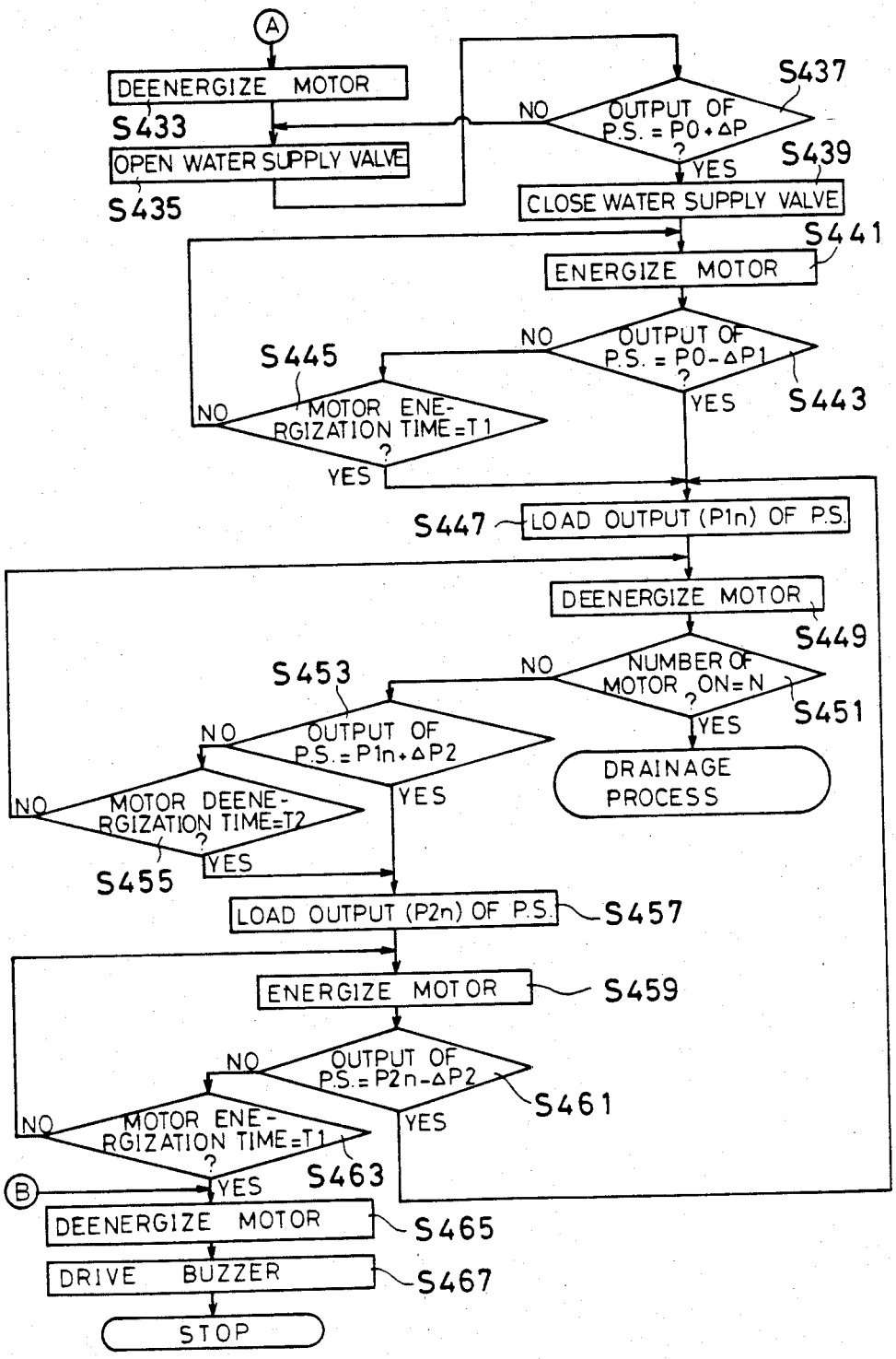

FIGS. 15A and 15B are flow diagrams for explaining another embodiment of the present invention. In the embodiment in FIG. 9, the timing for energizing or deenergizing the motor 34 was decided based upon the output change of the semiconductor pressure sensor 44 or the lapse of time. That is, in the embodiment in FIG. 9, the steps S129 and S131 were executed and the motor 34 was deenergized when either of the two conditions, whether the variation range of the output of the semiconductor pressure sensor 44 is more than ΔP2 or the time T1 elapses, was satisfied. When the variation range ΔP2 is not shown within the predetermined time T1, such disorders as the excessive load, the skip of the belt for transferring the motor rotation or the hindrance of the rotation of the agitator 30 by a foreign substance may be considered. When repeating ON and OFF of the motor 34 under such conditions, not only the washing performance is deteriorated but also the motor 34 is overheated and in the worst case there is a possibility that it will be burnt.

Now, in the embodiment, after the steps S401 through S431 corresponding to the steps S101 through S131 in the embodiment in FIG. 9 have been executed the steps S433 through S439 are performed. When the output of the semiconductor pressure sensor 44 does not decrease by ΔP2 within the predetermined time T1, then after the time T1 has elapsed, the motor 34 is once deenergized and the electromagnetic water supply valve 52 is opened. After supplying a predetermined amount of water till the output of the semiconductor pressure sensor 44 increases by, for example, ΔP, the motor 34 is energized again and the steps S441 through S463 corresponding to the previous steps S409 through S431 are performed.

Then, when the change more than the set value ΔP2 does not occur within the time T1 even after the steps S461 and S463 have been executed, the CPU 90 deenergizes the motor 34 at the next step S465 and gives the signal to the buzzer 114 through the interface 102 and sounds the buzzer 114 at the step S467. Through the buzz of the buzzer 114 the operator is able to notice that something wrong has happened.

Furthermore, when the high water level is set by the operator as the step S469 shown by the dotted lines in FIG. 15A, it may be arranged in such a manner that the motor 34 is stopped immediately and the buzzer 114 is operated without executing the steps S433 and thereafter, that is, without supplying the water.

In the embodiment shown in FIGS. 15A and 15B, it is understood that the same concept as shown in FIGS. 14A and 14B may be implemented.

Figure 16:
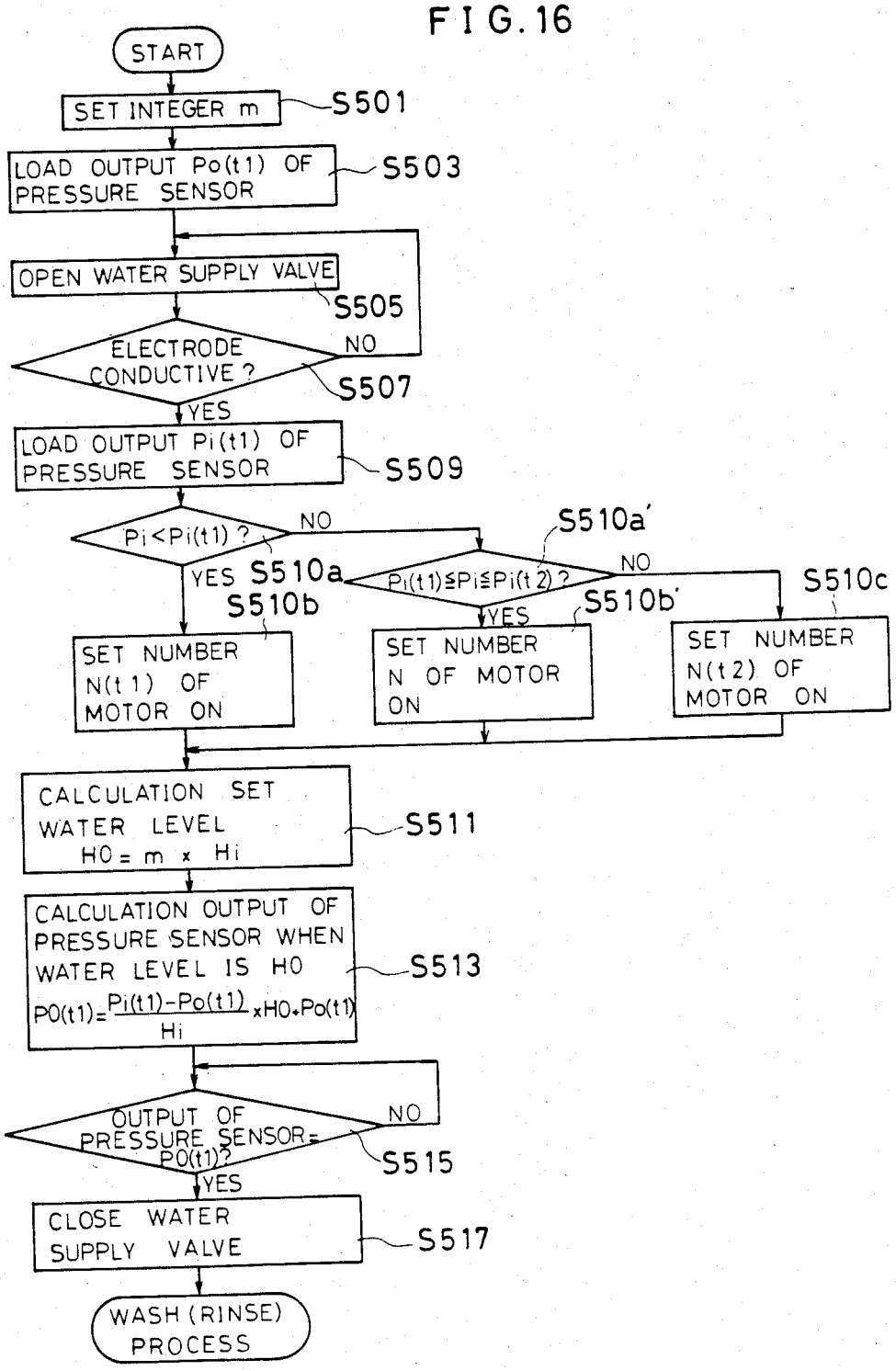
FIGS. 16 and 17 are flow diagrams for explaining different examples of water supplying processes respectively.
Figure 17:
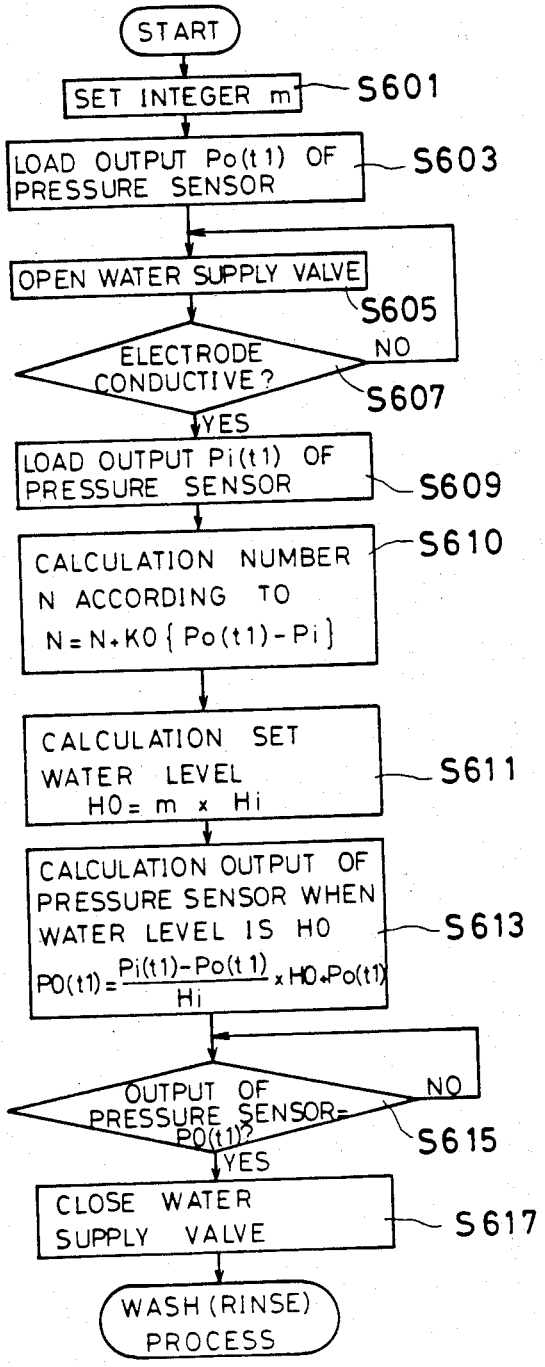

FIGS. 16 and 17 are flow diagrams for explaining the water supply process of another embodiment of the present invention respectively.

In general, there is a difference in the water temperature of approximately 20° C. depending on hot or cold, summer or winter or on the geographical locations. The higher the water temperature the better the washing performance. However, when the same set values ΔP1, ΔP2 and N are used regardless of such differences in the water temperatures, that is, if the wshing is performed under the same condition, the differences of washing performances will result in proportional to such temperature differences.

Now, thus the embodiment intends to change the number of repetitions N of the rotation and stop of the agitator 30 with the temperature, by making use of the fact that the semiconductor pressure sensor 44 without the temperature compensation tends to show the output characteristics as shown in FIG. 6.

That is, as shown in Table 3, the output of the semiconductor pressure sensor 44 for the respective case of the temperature t1 or t2(t1<t2) are defined in advance as Po(t1) and Po(t2) when the water level is zero and Pi(t1) or Pi(t2) when the water level is Hi, that is, when the electrodes 48 (FIG. 1) start conduction and then the number of repetitions N is set corresponding to such conditions as N(t1)>N>N(t2).

TABLE 3

| | t1 | t2 |
|---|---|---|
| Output of Pressure Sensor When Water Level is Zero | Po (t1) | Po (t2) |
| Output of Pressure Sensor When Water Level is Hi | Pi (t1) | Pi (t2) |
| Pi<Pi (t1) | Pi (t1) ≦Pi≦Pi (t2) | Pi (t2) <Pi |
| N (t1) | N | N (t2) |

An integer m is set at the first step S501 in FIG. 16. Then, the output Po of the semiconductor pressure sensor 44 when the water level is zero is read at the step S503 and after the steps S505 and S507, the output Pi of the semiconductor pressure sensor 44 responding to the water level when the electrodes 48 (FIG. 1) start conduction is read at the step S509. Now, the CPU 90 executes the steps S510*a* through S510*c* and compares the output Pi with the outputs Pi(t1) and Pi(t2) being set previously and stores the number of repetitions N(t1), N or N(t2) as shown in Table 3, for example, in the predetermined area of the RAM 94. That is, when comparing the cases Pi<Pi(t1) and Pi(t2)<Pi, the water temperature in the former case is lower. Therefore, the deterioration of the washing performance due to the low water temperature is intended to be compensated by increasing the number of rotation N.

More specifically, after executing the steps S510*a* and S510*a'*, the CPU 90 determines that in which range shown in Table 3 the output Pi of the semiconductor pressure sensor 44 is involved. Then, if Pi<Pi(t1) the CPU 90 takes it as the low water temperature and sets the maximum value N(t1) as the number of repetitions N at the step S510*b*. If Pi(t1)≦Pi≦Pi(t2) is determined at the step S510*a'*, the CPU 90 sets the standard value N at the step S510*b'*. When the Pi(t2)<Pi is determined at the step S510*a'*, the CPU 90 sets the minimum value N(t2) as the number of repetitions at the next step S510*c*.

Thereafter the steps S511 through S517 are executed as same as the steps S11 through S17 in previous FIG. 7(A).

In the embodiment in FIG. 17, the number of repetitions of ON and OFF of the motor 34 described above is adapted to be calculated. That is, only the temperature t1, the outputs Po(t1), Po(t2) of the semiconductor pressure sensor 44 and the number of repetitions N in Table 3 are defined and the number of repetitions of the rotation and stop of the agitator 30 is calculated at the step S610 based upon "N=N+KO (Po(t1)−Pi)". In this manner, when t1>t, {Po(t1)−Pi}shows a positive value, thus N<N(t1), while N>N(t1) in the reverse case. Accordingly, the lower the water temperature, the more the number of repetitions N may be increased as well as set steplessly (continuously).

Moreover, in the embodiment shown in FIGS. 16 and 17, since the temperature compensation is not required for the semiconductor pressure sensor 44, there is an advantage that the circuit configuration thereof may be simplified.

In the embodiments described above, the type utilizing the piezo diffusion resistance by using the silicon pellet 62 as the diaphragm as the pressure sensor was used in all cases. However, in the present invention, it is understood that the pressure sensor other than the type shown in the embodiment may be also used. For example, all types of pressure sensors which convert the mechanical displacement or distortion of the diaphragm or the bellows and the like responding to the pressure into the change of a capacitance, an inductance or a resistance, and all types which convert changes of the vibrating frequency of the piezo material, the metal wire, the cylinder and so on due to the pressure into the frequency.

Meanwhile, although the embodiment using the pressure sensor for detecting the change of the water level has been described, still various types of water level detecting systems may be considered, such as the system for detecting the variation of the water level by employing the ultrasonic transceiver and detecting the variation of the water level by measuring the reciprocating time of the ultrasonic wave, the system having a plurality of floats being provided inside the washing tub and detecting the variation of the water level by the respective float, or the system having a plurality of sets of electrodes such as the electrodes 48 (FIG. 1), being mounted on the side wall of the outer tub at every different water levels and detecting the variation of the water level by the conductions of the electrodes and so on.

In the meantime, in the embodiment described above, the continuation time and the brake timing of the inner tub 22 were decided based upon the time Td in the water-expelling process. However, it is not always necessary to use such time Td, for example, various systems may be employed such as the system using the points that the value of the motor current or the time for the changing rate of the current value to reach the predetermined value differs with the load and the system for detecting the load by the mean value of the motor current in the washing process and controlling the water-expelling time by the detected ooad, namely, the mean value of the motor current and so on.

Although the present invention has been described and illustrated in detail, it is clearly understood that the same is by way of illustration and example only and is not to be taken by way of limitation, the spirit and scope of the present invention being limited only by the terms of the appended claims.

I claim:

1. A washing machine comprising, an outer tub, an inner tub defined by at least a side wall being disposed within said outer tub, said inner tub provided with water-expelling holes within the side wall, a motor for rotating said inner tub, water level variation detecting means for detecting variations of a water level between said outer and inner tubs, means for counting the time required for a changing rate of an output of said water level variation detecting means to become substantially constant after the rotation of said inner tub is started, and motor control means for controlling time of energizing said motor and rotating said inner tub based upon said time being counted by said counting means.

2. A washing machine in accordance with claim 1, which further comprises means for braking said inner tub and means for activating said braking means after predetermined time based upon said time being counted by said counting means after said motor is stopped.

* * * * *